US011338307B2

(12) United States Patent
Jin et al.

(10) Patent No.: US 11,338,307 B2
(45) Date of Patent: May 24, 2022

(54) SPRAY-HEAD ASSEMBLY AND SPRAY-HEAD APPARATUS

(71) Applicant: SZ DJI TECHNOLOGY CO., LTD., Shenzhen (CN)

(72) Inventors: Zhiliang Jin, Shenzhen (CN); Xumin Wu, Shenzhen (CN); Xiaolong Wu, Shenzhen (CN); Chuoying Lu, Shenzhen (CN); Le Zhou, Shenzhen (CN)

(73) Assignee: SZ DJI TECHNOLOGY CO., LTD., Shenzhen (CN)

( * ) Notice: Subject to any disclaimer, the term of this patent is extended or adjusted under 35 U.S.C. 154(b) by 108 days.

(21) Appl. No.: 16/161,614

(22) Filed: Oct. 16, 2018

(65) Prior Publication Data

US 2019/0047000 A1 Feb. 14, 2019

Related U.S. Application Data

(63) Continuation of application No. PCT/CN2016/083978, filed on May 30, 2016.

(51) Int. Cl.
*B05B 1/30* (2006.01)

(52) U.S. Cl.
CPC ..... *B05B 1/3006* (2013.01); *B05B 1/30* (2013.01)

(58) Field of Classification Search
CPC ..... B05B 1/30; B05B 1/3013; B05B 1/3026; B05B 1/3033; B05B 1/308; B05B 1/3006; B05B 15/534; B05B 11/3038; F16K 7/07; F16K 7/075; F16K 31/3855; F16K 31/402; F16K 41/12; F16K 31/1221; F16K 31/363; F16K 31/383; F16K 41/103; F16K 13/00; F16K 31/385; F16K 47/08; F16K 7/12; F16K 7/17; F16K 31/1262; F16K 31/1266; F16K 15/185; Y10T 137/85954; B65D 47/2018–305
(Continued)

(56) References Cited

U.S. PATENT DOCUMENTS 5,785,246 A 7/1998 King et al.
6,079,437 A * 6/2000 Beutler ..... F16K 31/385 137/181
(Continued)

FOREIGN PATENT DOCUMENTS

CN 1614637 A 5/2005
CN 101670323 A 3/2010
(Continued)

OTHER PUBLICATIONS

The World Intellectual Property Organization (WIPO) International Search Report for PCT/CN2016/083978 dated Feb. 23, 2017 5 Pages.

*Primary Examiner* — Darren W Gorman
*Assistant Examiner* — Juan C Barrera
(74) *Attorney, Agent, or Firm* — Anova Law Group, PLLC

(57) ABSTRACT

A spray-head assembly includes a pipe structure and a valve-spool. The pipe structure includes a liquid inlet, a flow pathway, and a valve-port. The flow pathway includes an air-flow pathway arranged obliquely with respect to a central axis of the liquid inlet. A bottom end of the air-flow pathway communicates with the liquid inlet. The valve-port is arranged at a top end of the air-flow pathway. The valve-spool is arranged in the flow pathway and configured to control opening and closing of the valve-port.

17 Claims, 5 Drawing Sheets

(58) Field of Classification Search
USPC ..... 239/569–586, 124–127; 222/490–494; 137/218
See application file for complete search history.

(56) References Cited

U.S. PATENT DOCUMENTS

| | | | | |
|---|---|---|---|---|
| 6,374,855 | B1 * | 4/2002 | Hansen | F16K 17/02 137/510 |
| 6,792,962 | B1 * | 9/2004 | Smith | F16K 15/08 137/12 |
| 2003/0189111 | A1 * | 10/2003 | Heren | B05B 1/3013 239/570 |
| 2006/0163513 | A1 * | 7/2006 | Ishikawa | F16K 31/0658 251/129.17 |
| 2008/0099711 | A1 | 5/2008 | Wang | |
| 2014/0316614 | A1 | 10/2014 | Newman | |
| 2016/0018041 | A1 | 1/2016 | Mawby | |

FOREIGN PATENT DOCUMENTS

| | | | |
|---|---|---|---|
| CN | 202321216 | U | 7/2012 |
| CN | 103499346 | A | 1/2014 |
| CN | 203623605 | U | 6/2014 |
| CN | 104035446 | A | 9/2014 |
| CN | 104850134 | A | 8/2015 |
| CN | 105159297 | A | 12/2015 |
| CN | 105571588 | A | 5/2016 |
| CN | 105955290 | A | 9/2016 |
| CN | 106054920 | A | 10/2016 |
| CN | 205761868 | U | 12/2016 |
| JP | S50027112 | A | 3/1975 |
| JP | S57028762 | U | 2/1982 |
| JP | 2014014351 | A | 1/2014 |
| KR | 1020090072355 | A | 7/2009 |
| WO | 9001373 | A1 | 2/1990 |

* cited by examiner

SPRAY-HEAD ASSEMBLY AND SPRAY-HEAD APPARATUS

CROSS-REFERENCE TO RELATED APPLICATION

This application is a continuation application of International Application No. PCT/CN2016/083978, filed on May 30, 2016, the entire contents of which are incorporated herein by reference.

TECHNICAL FIELD

The present disclosure relates to a spray-head assembly and a spray-head apparatus using the same.

BACKGROUND

A spraying system is used for spraying pesticides, fertilizers, water, and other liquids in the field of, for example, agricultural production and plant protection. A spray-head apparatus installed at an end of a pipeline of the spraying system is used for spraying liquids on the surface of the crops. The conventional spray-head apparatuses have gas retained in an internal flow pathway, such that starting and stopping speeds of the spray are relatively low, thereby causing difficulties in controlling the spray range.

SUMMARY

In accordance with the disclosure, there is provided a spray-head assembly including a pipe structure and a valve-spool. The pipe structure includes a liquid inlet, a flow pathway, and a valve-port. The flow pathway includes an air-flow pathway arranged obliquely with respect to a central axis of the liquid inlet. A bottom end of the air-flow pathway communicates with the liquid inlet. The valve-port is arranged at a top end of the air-flow pathway. The valve-spool is arranged in the flow pathway and configured to control opening and closing of the valve-port.

Also in accordance with the disclosure, there is provided a spray-head apparatus including a spray-head assembly and a nozzle assembly detachably connected to the spray-head assembly. The spray-head assembly includes a pipe structure and a valve-spool. The pipe structure includes a liquid inlet, a flow pathway, a valve-port, and a liquid outlet. The flow pathway includes an air-flow pathway arranged obliquely with respect to a central axis of the liquid inlet. A bottom end of the air-flow pathway communicates with the liquid inlet. The valve-port is arranged at a top end of the air-flow pathway. The valve-spool is arranged in the flow pathway and configured to control opening and closing of the valve-port. The liquid inlet and the liquid outlet are arranged at two opposite sides of the flow pathway. The nozzle assembly communicates with the liquid outlet.

Figure 1:
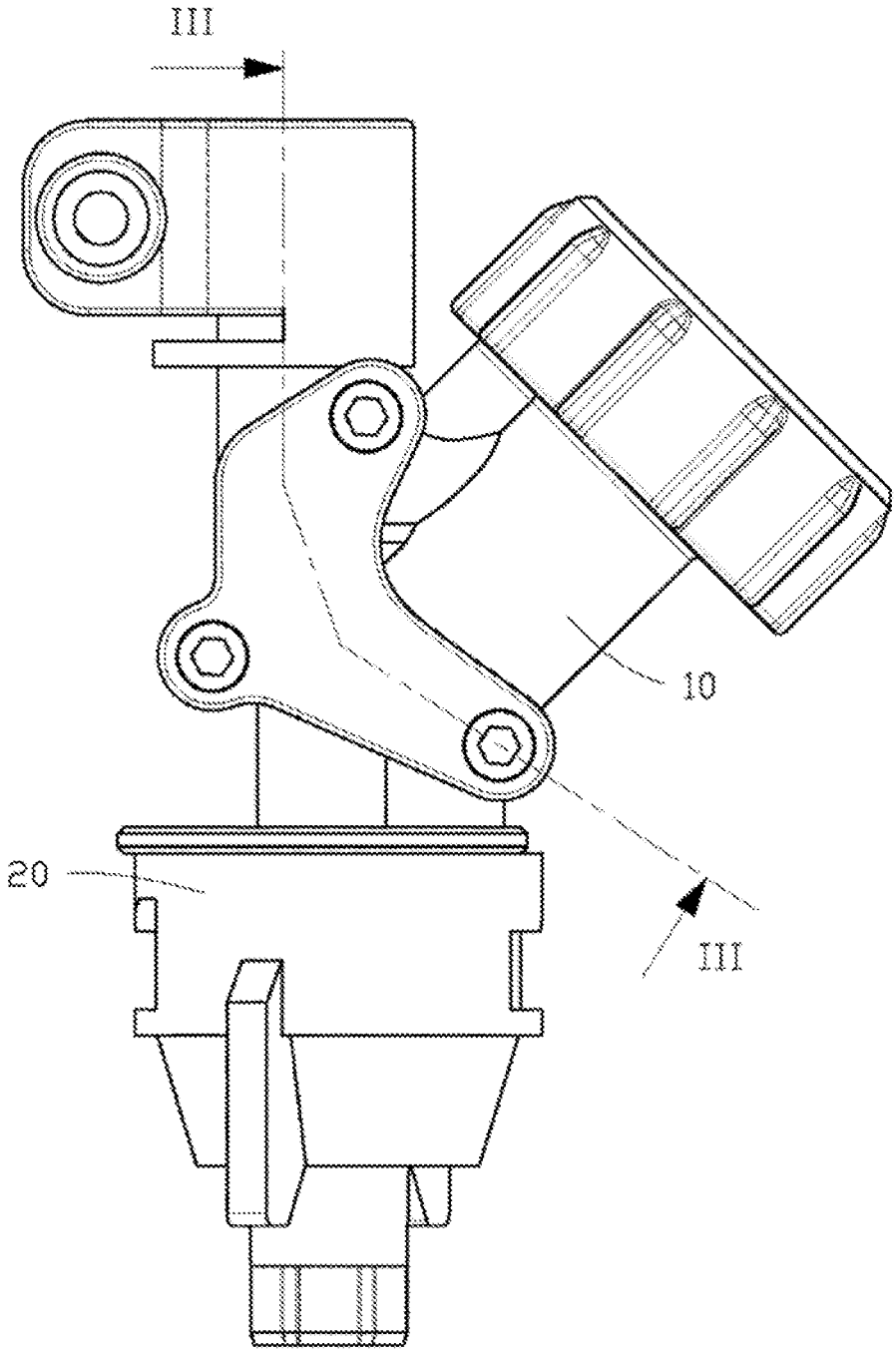
FIG. 1 is a perspective view of a spray-head apparatus according to an embodiment of the disclosure.

| Description of Reference Numerals | |
|---|---|
| Spray-head apparatus | 100 |
| Spray-head assembly | 10 |
| Nozzle assembly | 20 |
| Liquid inlet | 102 |
| Flow pathway | 103 |
| Valve-port | 104 |
| Liquid outlet | 105 |
| First main flow pathway | 1031 |
| Air-flow pathway, or chamber | 1033 |
| Connecting flow pathway | 1032 |
| Backflow pathway | 1034 |
| Second main flow pathway | 1035 |
| Valve body | 11 |
| Side pressure-cover | 12 |
| Filter | 14 |
| Pressure ring | 16 |
| Valve-spool | 17 |
| Top pressure-cover | 18 |
| Fixing member | 19 |
| Trunk | 111 |
| Branch | 116 |
| Sealing groove | 112 |
| First fixing hole | 113 |
| Sleeve clamp | 114 |
| Internal thread | 1111, 181 |
| Quick connect fitting | 115 |
| Receiving groove | 117 |
| First alignment structure | 1171 |
| Step portion | 118 |
| External thread | 119 |
| Second fixing hole | 121 |
| First sealing member | 13 |
| Edge portion | 141 |
| Extending portion | 143 |
| First through hole | 161 |
| Notch | 163 |
| Second alignment structure | 165 |
| Sealing portion | 171 |
| Elastic portion | 173 |
| Connecting portion | 175 |
| Flow-guiding portion | 177 |
| Second sealing member | 15 |
| Second through hole | 151 |
| Third through hole | 153 |
| Third alignment structure | 155 |
| Locking structure | 21 |

DETAILED DESCRIPTION OF THE EMBODIMENTS

Technical solutions of the present disclosure will be described with reference to the drawings. It will be appreciated that the described embodiments are some rather than all of the embodiments of the present disclosure. Other embodiments conceived by those having ordinary skills in the art on the basis of the described embodiments without inventive efforts should fall within the scope of the present disclosure.

As used herein, when a first component is referred to as "fixed to" a second component, it is intended that the first component may be directly attached to the second component or may be indirectly attached to the second component via another component. When a first component is referred to as "connected" to a second component, it is intended that the first component may be directly connected to the second component or may be indirectly connected to the second component via a third component between them. When a first component is referred to as "arranged" at a second component, it is intended that the first component may be directly arranged at the second component or may be indirectly arranged at the second component via a third component between them. When a first flow pathway is referred to as "communicating" with a second flow pathway, it is intended that the first flow pathway may directly communicate with the second flow pathway or may indirectly communicate with the second flow pathway via a third flow pathway between them.

Unless otherwise defined, all the technical and scientific terms used herein have the same or similar meanings as generally understood by one of ordinary skill in the art. As described herein, the terms used in the specification of the present disclosure are intended to describe exemplary embodiments, instead of limiting the present disclosure. The term "and/or" used herein includes any suitable combination of one or more related items listed.

The terms "top end," "bottom end" "top," "bottom," used herein are defined in terms of a distance from the ground, when the spray-head apparatus is in a normal use state. "Top" and "top end" refer to objects far from the ground and "bottom" and "bottom end" refer to objects near the ground.

Exemplary embodiments will be described with reference to the accompanying drawings. Unless conflicting, the embodiments or some features of the embodiments can be combined with each other.

FIG. 1 is a perspective view of a spray-head apparatus 100 consistent with the disclosure. As shown in FIG. 1, the spray-head apparatus 100 includes a spray-head assembly 10 and a nozzle assembly 20. The nozzle assembly 20 is detachably connected to the spray-head assembly 10.

Figure 2:
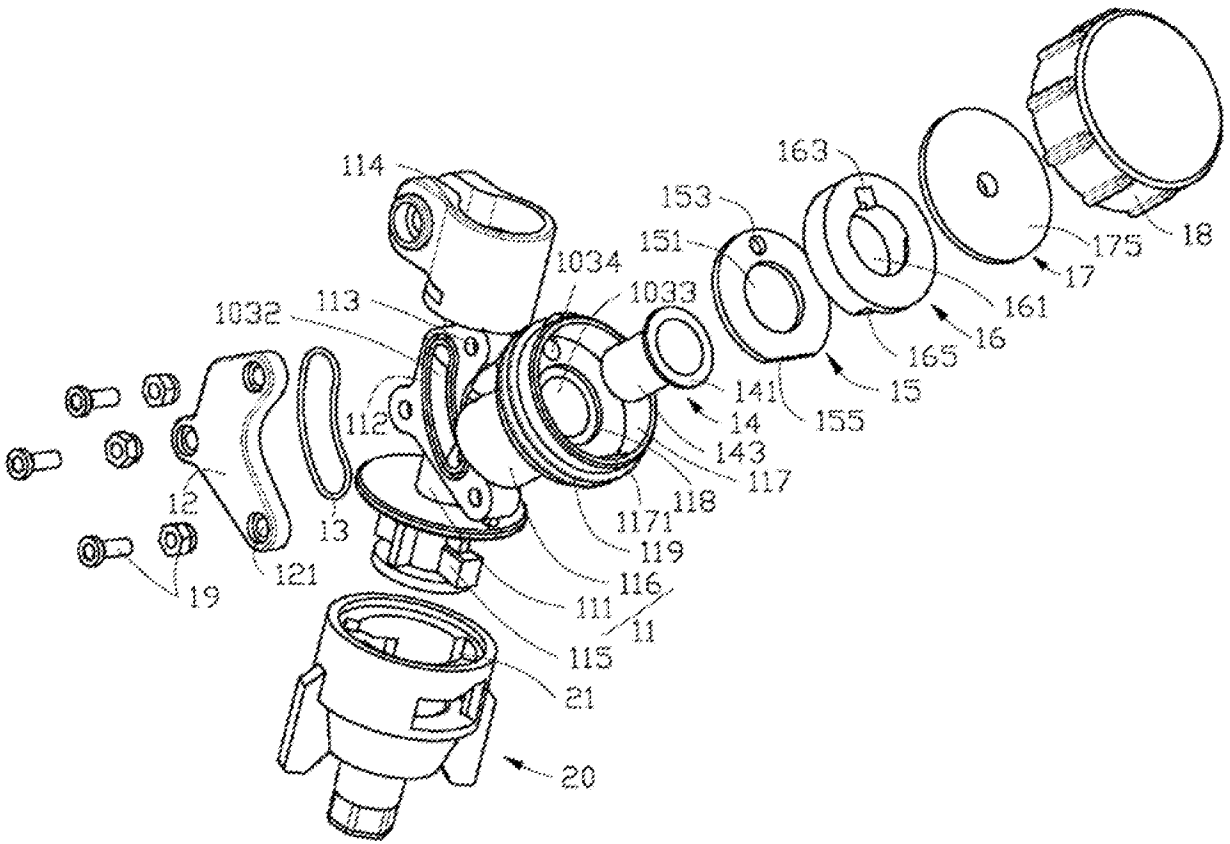
FIG. 2 is an exploded view of the spray-head apparatus in FIG. 1.
Figure 3:
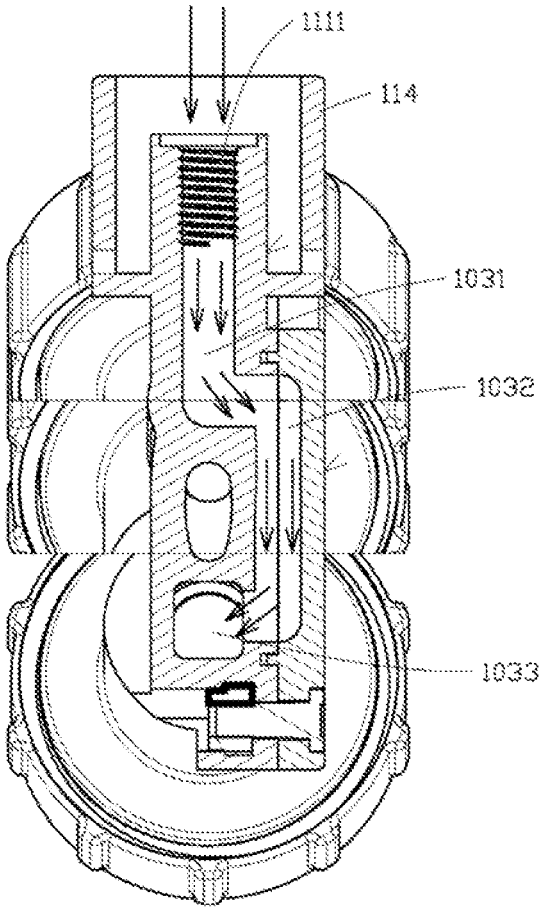
FIG. 3 is a cross-sectional view along line of the spray-head apparatus in FIG. 1.
Figure 4:
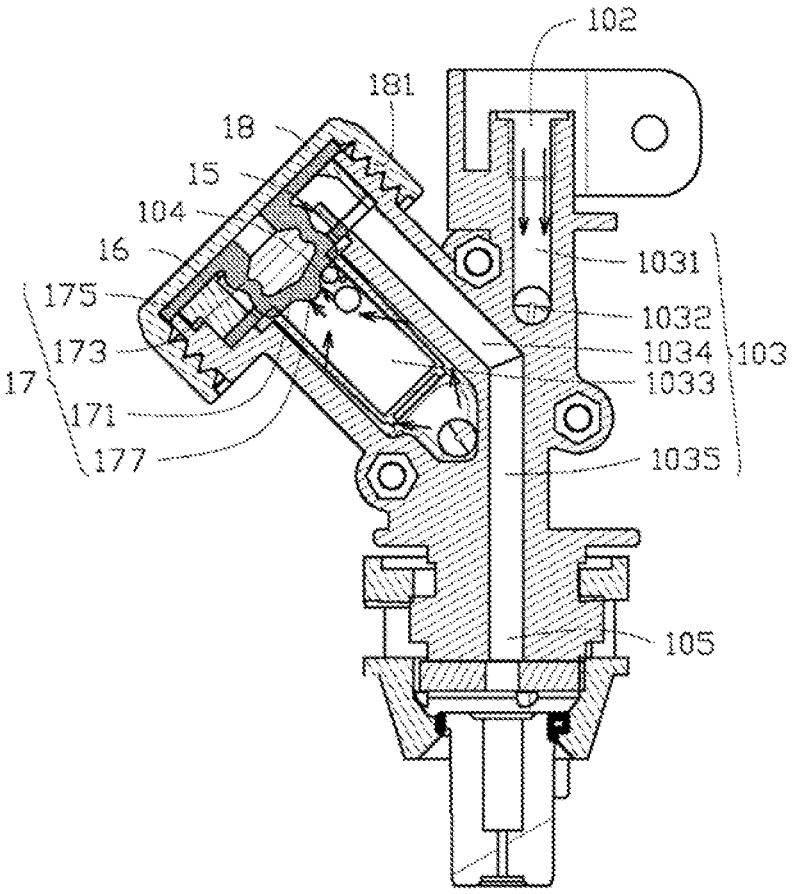
FIG. 4 is a cross-sectional view along another line of the spray-head apparatus in FIG. 1.

FIG. 2 is an exploded view of the spray-head apparatus 100 consistent with the disclosure. FIG. 3 is a cross-sectional view along line of the spray-head apparatus 100 consistent with the disclosure. FIG. 4 is a cross-sectional view along another line of the spray-head apparatus 100 consistent with the disclosure. A pipe structure is provided inside the spray-head assembly 10. As shown in FIG. 4, the pipe structure 101 includes a liquid inlet 102, a flow pathway 103, a valve-port 104, and a liquid outlet 105. The liquid inlet 102 and the liquid outlet 105 are arranged at two opposite ends of the flow pathway 103. The valve-port 104 is arranged inside the flow pathway 103 and communicates with the flow pathway 103.

The flow pathway 103 includes an air-flow pathway 1033, which is also called a chamber 1033. The "air-flow pathway" and the "chamber" are interchangeably used in the present disclosure." The air-flow pathway or the chamber 1033 is arranged obliquely with respect to a central axis of the liquid inlet 102. The flow pathway 103 further includes a first main flow pathway 1031 communicating with the air-flow pathway 1033. In some embodiments, as shown in, e.g., FIG. 4, the air-flow pathway 1033 is arranged obliquely with respect to the first main flow pathway 1031. The liquid inlet 102 is arranged at a top end of the first main flow pathway 1031. A bottom end of the air-flow pathway 1033 communicates with the liquid inlet 102.

The flow pathway 103 further includes a connecting flow pathway 1032 communicating between the first main flow pathway 1031 and the air-flow pathway 1033.

The flow pathway 103 further includes a backflow pathway 1034 that can selectively communicate with a top end of the air-flow pathway 1033. The backflow pathway 1034 is arranged obliquely with respect to the first main flow pathway 1031. In some embodiments, as shown in FIG. 4, the backflow pathway 1034 is approximately parallel to the air-flow pathway 1033. The backflow pathway 1034 is closer to the first main flow pathway 1031 than the air-flow pathway 1033.

The flow pathway 103 further includes a second main flow pathway 1035 communicating with the backflow pathway 1034. The second main flow pathway 1035 is approximately parallel to the first main flow pathway 1031. The liquid outlet 105 is arranged at a bottom end of the second main flow pathway 1035. In some embodiments, the first main flow pathway 1031 is parallel to an extending direction of the second main flow pathway 1035, such that a flow direction of liquid in the first main flow pathway 1031 is approximately same as the flow direction of the liquid in the second main flow pathway 1035.

In some embodiments, the first main flow pathway 1031, the connecting flow pathway 1032, the air-flow pathway 1033, the backflow pathway 1034, and the second main flow pathway 1035 can include a straight-line flow pathway. In some other embodiments, at least one of the first main flow pathway 1031, the connecting flow pathway 1032, the air-flow pathway 1033, the backflow pathway 1034, and the second main flow pathway 1035 can include a curve-line flow pathway.

In some embodiments, as shown in FIG. 4, a cross-section area of the air-flow pathway 1033 is greater than the cross-section areas of the first main flow pathway 1031, the connecting flow pathway 1032, the backflow pathway 1034, and the second main flow pathway 1035. The cross-section areas of the first main flow pathway 1031, the connecting flow pathway 1032, the backflow pathway 1034, and the second main flow pathway 1035 can be approximately the same.

In some other embodiments, the cross-section area of the air-flow pathway 1033 can be approximately equal to the cross-section areas of the first main flow pathway 1031, the connecting flow pathway 1032, the backflow pathway 1034, and the second main flow pathway 1035.

As shown in FIG. 2, the spray-head assembly 10 includes a valve body 11, a side pressure-cover 12, a filter 14, a pressure ring 16, a valve-spool 17, a top pressure-cover 18, and a fixing member 19.

The pipe structure 101 is arranged inside the valve body 11. The valve body 11 includes a trunk 111 and a branch 116. In some embodiments, as shown in FIG. 2, the truck 111 and the branch 116 form a Y-shape-like structure.

The liquid inlet 102 and the liquid outlet 105 are arranged at two opposite ends of the trunk 111, respectively. For example, as shown in FIG. 4, the liquid inlet 102 is arranged at a top end of the trunk 111 and the liquid outlet 105 is arranged at a bottom end of the trunk 111. The first main flow pathway 1031 and the second main flow pathway 1035 are arranged inside the trunk 111. The first main flow pathway 1031 is close to the top end of the trunk 111 and the second main flow pathway 1035 is close to the bottom end of the trunk 111. The air-flow pathway 1033 and the backflow pathway 1034 are arranged inside the branch 116. The connecting flow pathway 1032 is arranged inside a junction between the trunk 111 and the branch 116. In some embodiments, as shown in FIG. 2, the connecting flow pathway 1032 protrudes from a side of the valve body 11. A sealing groove 112 is provided by the valve body 11 around the connecting flow pathway 1032. The valve further includes a plurality of first fixing holes 113. The plurality of first fixing holes 113 are arranged around the sealing groove 112.

A sleeve clamp 114 is arranged at the top end of the trunk 111 and is coaxial with the first main flow pathway 1031. The sleeve clamp 114 can be configured to fix an external supporting structure (not shown in FIG. 2), such as a supporting rod. In some embodiments, as shown in FIG. 3, an internal thread 1111 is provided inside the top end of the first main flow pathway 1031 that is close to the liquid inlet 102. The internal thread 1111 is configured to mount a fixed liquid-supply connector (not shown in FIG. 3). A quick connect fitting 115 is arranged at the bottom end of the trunk 111.

A receiving groove 117 is provided inside a top end of the branch 116. The air-flow pathway 1033 and the backflow pathway 1034 communicate with the receiving groove 117. In some embodiments, the top end of the air-flow pathway 1033 and a top end of the backflow pathway 1034 protrude from a bottom of the receiving groove 117. The receiving groove 117 is coaxial with the air-flow pathway 1033. A first alignment structure 1171 is formed on an inner side of the receiving groove 117. In some embodiments, the first alignment structure 1171 and an opening port of the backflow pathway 1034 protruding from the bottom of the receiving groove 117 are arranged at two opposite sides of an opening port of the air-flow pathway 1033 protruding from the bottom of the receiving groove 117. An annular step portion 118 is formed by inwardly recessing a center area of the receiving groove 117. The annular step portion 118 is coaxial with the air-flow pathway 1033. An external thread 119 is provided outside the top end of the branch 116.

The side pressure-cover 12 is fixed at the junction between the trunk 111 and the branch 116. The side pressure-cover 12 closes the connecting flow pathway 1032. A plurality of second fixing holes 121 are provided at the side pressure-cover 12. The plurality of second fixing holes 121 correspond to the plurality of first fixing holes 113, respectively. The side pressure-cover 12 can be fixed on the valve body 11 through the plurality of second fixing holes 121, the plurality of first fixing holes 113, and the fixing member 19 cooperating to each other.

In some embodiments, the pray-head assembly 10 further includes a first sealing member 13. The first sealing member 13 is arranged between the side pressure-cover 12 and the valve body 11. In some embodiments, the first sealing member 13 is arranged inside the sealing groove 112 and is configured to seal a gap between the side pressure-cover 12 and the valve body 11. The first sealing member 13 can include a rubber ring made of rubber or silicone.

In some embodiments, the first sealing member 13 and the side pressure-cover 12 can be one-piece molded. For example, the first sealing member 13 can be an elastic annular-protrusion structure protruding from a surface of the side pressure-cover 12 opposite to the valve body 11. The first sealing member 13 corresponds to the sealing groove 112. When the side pressure-cover is fixed on the valve body 11, the first sealing member 13 can seal the gap between the side pressure-cover 12 and the valve body 11.

In some embodiments, the first sealing member 13 and the sealing groove 112 can be omitted.

In some embodiments, the side pressure-cover 12 and the valve body 11 can be one-piece molded. In this situation, the first sealing member 13, the sealing groove 112, the plurality of first fixing holes 113, and the fixing member 19 can be omitted.

In some embodiments, the side pressure-cover 12 can be fixedly adhered to the valve body 11 by an adhesive. In this situation, the plurality of first fixing holes 113, and the fixing member 19 can be omitted.

In some embodiments, other sealing groove structures can be arranged around the sealing groove 12 to further improve the sealing effect. The spray-head assembly 10 can further include other sealing members to cooperate with the other sealing groove structures.

The filter 14, the pressure ring 16, the valve-spool 17, and the top pressure-cover 18 are arranged at the top end of the branch 116. In some embodiments, the filter 14, the pressure ring 16, and the valve-spool 17 are arranged in the receiving groove 117. The top pressure-cover 18 is arranged at the top end of the branch 116 and closes the receiving groove 117. The pressure ring 16 prestresses an end of the valve-spool 17 against the top pressure-cover 18. Another end of the valve-spool 17 elastically abuts against the valve-port 104 to control opening and closing of the valve-port 104.

An end of the filter 14 is fixed on the valve-port 104, and another end of the filter 14 extends into the air-flow pathway 1033. The filter 14 has a cap-shape-like structure and includes an edge portion 141 and an extending portion 143. The edge portion 141 is coaxial with the extending portion 143. The edge portion 141 is arranged at an end of the extending portion 143 and extends outwardly along with a direction that is perpendicular to an axial direction of the filter 14. In some embodiments, the extending portion 143 can extend into the air-flow pathway 1033. The edge portion 141 is arranged at the step portion 118.

The pressure ring 16 is arranged in the receiving groove 117. A first through hole 161 is provided at the pressure ring 16. The first through hole 161 is arranged along an axis of the pressing ring 16 and is aligned with the air-flow pathway 1033. A notch 163 communicating with the first through hole 161 is provided by the pressing ring 16 along an edge of the first through hole 161. The notch 163 is aligned with the backflow pathway 1034. When the valve-port is opened, the first through hole 161 can communicate with the air-flow pathway 1033 and the notch 163 can communicate with the backflow pathway 1034, such that the air-flow pathway 1033 can communicate with the backflow pathway 1034. A second alignment structure 165 is provided at an outer edge of the pressure ring 16. In some embodiments, the second alignment structure 165 and the notch 163 are arranged at two opposite sides of the first through hole 161. The second alignment structure 165 is aligned with the first alignment structure 1171, such that the first through hole 161 can be aligned with the air-flow pathway 1033 and the notch 163 can be aligned with the backflow pathway 1034, after the pressure ring 16 is assembled into the receiving groove 117.

The valve-spool 17 is arranged in the pipe structure 101. In some embodiments, the valve-spool 17 can be arranged in the flow pathway 103 to control the opening and closing of the valve-port 104.

In some embodiments, the valve-spool 17 can be one-piece molded and can be elastically deformed. As shown in FIG. 4, an end of the valve-spool 17 is elastically abuts against the valve-port 104. The valve-spool 17 can seal the valve-port 104 and can be elastically deformed to release the sealing of the valve-port 104, when a hydraulic pressure in the air-flow pathway 1033 has reached a preset value. In some embodiments, the valve-spool 17 is made of an elastic resin material, such as rubber or silicone.

In some embodiments, as shown in FIG. 4, the valve-spool 17 includes a sealing portion 171, an elastic portion 173, a connecting portion 175, and a flow-guiding portion 177. The sealing portion 171 and the connecting portion 175 are arranged opposite to each other. The sealing portion 171 and the connecting portion 175 are connected at two opposite ends of the elastic portion 173. The pressure ring 16 can prestress the connecting portion 175 against the top pressure-cover 18. The sealing portion 171 can pass through the first through hole 161 and elastically abut the valve-port 104.

The sealing portion 171 can elastically abut the valve-port 104 to achieve the sealing and opening of the valve-port 104, and further realize the blocking and communication between the backflow pathway 1034 and the air-flow pathway 1033.

The elastic portion 173 connects to the sealing portion 171. The elastic portion 173 can prestress the sealing portion 171 against the valve-port 104, such that the sealing portion 171 can seal the valve-port 104 to block the backflow pathway 1034 from the air-flow pathway 1033. When the hydraulic pressure in the air-flow pathway 1033 has reached a preset value, the sealing portion 171 can abut against the elastic portion 173 to elastically deform the elastic portion 173 to release the sealing of the valve-port 104, such that the backflow pathway 1034 can communicate with the air-flow pathway 1033.

The elastic portion 173 can be inwardly recessed, outwardly protruded, or arranged in a multi-stage bending manner along a direction that is perpendicular to an axial direction of the valve-spool 17. In some embodiments, the elastic portion 173 can be recessed toward the inside of the valve-spool 17 along the direction that is perpendicular to the axial direction of the valve-spool 17. The elastic portion 173 and the sealing portion 171 together can form a hollow cavity to facilitate the elastic deformation of the elastic portion 173.

The connecting portion 175 is connected to an end of the elastic portion 173 distal from the sealing portion 171. In some embodiments, the connecting portion 175 can have a disk-shaped structure extending outwardly in the direction that is perpendicular to the axial direction of the valve-spool 17. An outer edge of the connecting portion 175 can be arranged between the top pressure-cover 18 and the top end of the branch 116.

The flow-guiding portion 177 protrudes from the sealing portion 171 in a direction away from the elastic portion 173. The flow-guiding portion 177 protrudes into the air-flow pathway 1033. In some embodiments, the flow-guiding portion 177 protrudes from a middle of the sealing portion 171. The flow-guiding portion 177 can have a cone-shaped or tapered-shape-like structure. A diameter of the flow-guiding portion 177 gradually decreases as a distance to the sealing portion 171 increases.

When a water pump (not shown in FIG. 4) communicating with the flow pathway 103 stops working, the hydraulic pressure in the air-flow pathway 1033 gradually decreases and an elastic of the elastic portion 173 gradually recovers, such that the sealing portion 171 can seal the valve-port 104 and the pray-head apparatus 100 will not leak after the water pump is stopped.

The top pressure-cover 18 can be fixed to the top end of the branch 116 and closes the receiving groove 117. The internal thread 181 formed inside the top pressure-cover 18 can engage with the external thread 119. The top pressure-cover 18 can fixed on the top of the branch 116 through a cooperation of the external thread 119 and the internal thread 181.

In some embodiments, as shown in FIGS. 2 and 4, the spray-head assembly 10 further includes a second sealing member 15. The second sealing member 15 is arranged between the pressure ring 16 and the bottom of the receiving groove 117. The second sealing member 15 is provided with a second through hole 151 aligned with the air-flow pathway 1033 and a third through hole 153 aligned with the backflow pathway 1034. The second through hole 151 is aligned with and communicates with the first through hole 161. The third through hole 153 is aligned with and communicates with the notch 163. In some embodiments, the second through hole 151 and the third through hole 153 are spaced apart from each other. A third alignment structure 155 is arranged at an outer edge of the second seal member 15. The third alignment structure 155 and the third through hole 153 are arranged at two opposite sides of the second through hole 151. The third alignment structure 155 corresponds to the second alignment structure 165 and is configured to cooperate with the first alignment structure 1171 for alignment, such that the second through hole 151 can be aligned with the air-flow pathway 1033, and the third through hole 153 can be aligned with the backflow pathway 1034, after the second sealing member 15 is assembled into the receiving groove 117. In some embodiments, the second sealing member 15 can include a sealing ring.

In some embodiments, the second sealing member 15 can be omitted.

In some embodiments, the first alignment structure 1171, the second alignment structure 165, and the third alignment structure 155 can be omitted.

As shown in FIG. 2, the nozzle assembly 20 is detachably connected to the bottom end of the trunk 111. The nozzle assembly 20 can be fastened to the bottom end of the trunk 111 by screwing. The nozzle assembly 20 includes a locking structure 21 that cooperates with the quick connect fitting 115. The nozzle assembly 20 can be fixed to the bottom end of the trunk 111 of the valve body 11 through the cooperation of the quick connect fitting 115 and the locking structure 21. The inside of the nozzle assembly 20 and the liquid outlet 105 communicate with each other.

Figure 5:
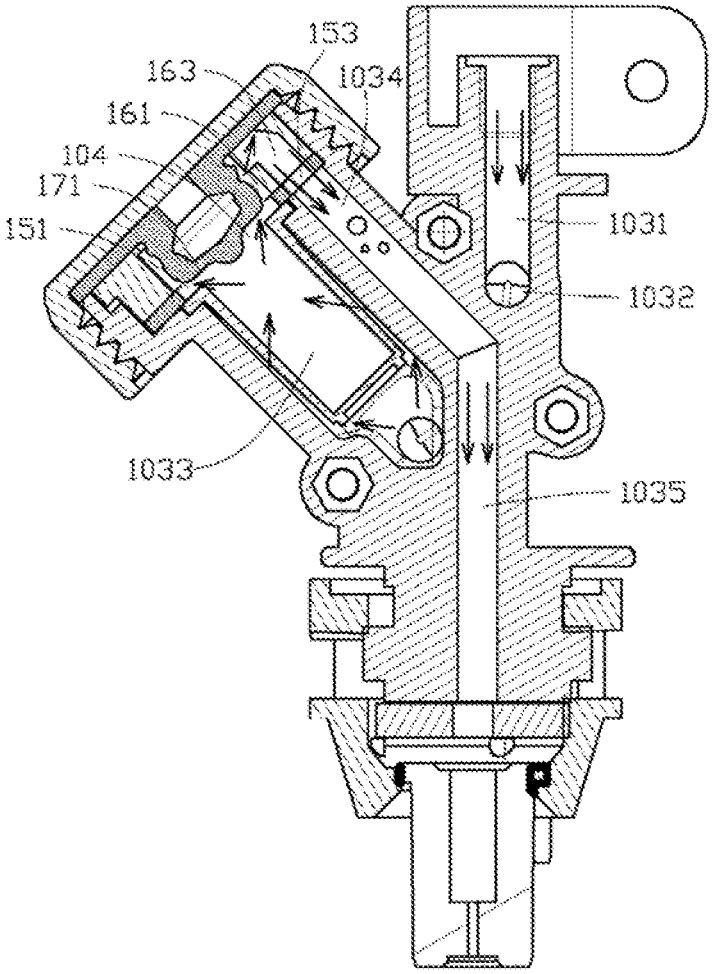
FIG. 5 schematically shows the spray-head apparatus in FIG. 4 in an opening state.

FIG. 5 schematically shows the spray-head apparatus in FIG. 4 in an opening state. During operation, as shown in FIGS. 4 and 5, liquid enters the first main flow pathway 1031 from the liquid inlet 102, flows through the connecting flow pathway 1032, and flows into the air-flow pathway 1033. The gas retained in the air-flow pathway 103 will be gradually gathered at the top end of the air-flow pathway 1033 as the liquid in the air-flow pathway 1033 increases and in the meanwhile, the hydraulic pressure in the air-flow pathway 1033 will gradually increases. When the hydraulic pressure in the air-flow pathway 1033 is less than the preset value, the elastic portion 173 of the valve-spool 17 can prestress the sealing portion 171 against the valve-port 104 to seal the valve-port 104. When the hydraulic pressure in the air-flow pathway 1033 reaches the preset value, the elastic portion 173 of the valve-spool 17 can be elastically deformed and the sealing portion 171 of the valve-spool 17 can be separated from the valve-port 104 to release the sealing portion 171 from sealing the valve-port 104, such that the air-flow pathway 1033 can communicate with the backflow pathway 1034 through the second through hole 151, the first through hole 161, the notch 163, and the third through hole 153. When the valve-port 104 is opened, the gas retained in the flow pathway 103 can enter the backflow pathway 1034 with the liquid and can be discharged through the second main flow pathway 1035. In some embodiments, the preset value can be a minimum hydraulic pressure for separating the sealing portion 171 from the valve-port 104.

In some embodiments, the valve-spool 17 can include a combination of a valve stem, a spring, and a sealing ring. The sealing ring can be fixed to an end of the valve steam for sealing the valve-port 104. The spring can be connected to another end of the valve stem or sleeved on the valve stem. The spring can be configured to prestress the valve stem, such that the sealing ring can seal the valve-port 104, when the spray stops.

According to the disclosed spray-head assembly and the disclosed spray-head apparatus, the flow pathway of the pipe structure can include the first main flow pathway and the air-flow pathway communicating with the first main flow pathway, the air-flow pathway can be obliquely arranged relative to the first main flow pathway, the valve-port can be arranged at the top end of the air-flow pathway, and the bottom end of the air-flow pathway can communicate with the liquid inlet. As such, the gas retained in the flow pathway can be collected at the top end of the air-flow pathway, and when the valve-port is opened, the retained gas can overflow from the valve-port. Therefore, the problem that the retained gas causes the starting and stopping speeds of the spray-head to be slow can be avoided, thereby reducing the difficulty of controlling the spray range.

Those skilled in the art can conceive any modification or equivalents of the disclosed embodiments, which are intended to be encompassed within the scope of the present disclosure.

What is claimed is:

1. A spray-head assembly comprising:

a pipe structure including:

a liquid inlet;

a flow pathway including:

a chamber arranged obliquely with respect to a central axis of the liquid inlet, a bottom end of the chamber communicating with the liquid inlet, the chamber is configured to collect gas retained from the flow pathway, causing a hydraulic pressure in the chamber;

a first main flow pathway communicating with the chamber;

a backflow pathway arranged parallel to the chamber in communication with a top end of the chamber; and a second main flow pathway communicating with the backflow pathway and extending to a liquid outlet of the pipe structure, an obtuse angle being formed between the backflow pathway and the second main flow pathway; and a valve-port arranged at the top end of the chamber; and a valve-spool arranged in the flow pathway and configured to control opening or closing of the valve-port in response to the hydraulic pressure being higher or lower than a preset value respectively.

2. The assembly of claim 1, wherein:

the liquid inlet is arranged at a top end of the main flow pathway.

3. The assembly of claim 2, wherein:

the flow pathway further includes a connecting flow pathway between the main flow pathway and the chamber.

4. The assembly of claim 3, wherein:

the valve-spool is further configured to open and close the valve-port to block and open a communication between the backflow pathway and the chamber.

5. The assembly of claim 4, wherein:

the backflow pathway is closer to the main flow pathway than the chamber.

6. The assembly of claim 1, wherein:

the second main flow pathway is parallel to the first main flow pathway.

7. The assembly of claim 1, wherein:

a cross-section area of the chamber is greater than cross-section areas of the first main flow pathway, the connecting flow pathway, the backflow pathway, and the second main flow pathway.

8. The assembly of claim 1, wherein:

cross-section areas of the first main flow pathway, the connecting flow pathway, the backflow pathway, and the second main flow pathway are configured to be the same.

9. The assembly of claim 1, wherein:

the liquid outlet is arranged at a bottom end of the second main flow pathway.

10. The assembly of claim 9, further comprising:

a valve-body;

wherein the pipe structure is arranged inside the valve-body.

11. The assembly of claim 10, wherein:

the valve body includes a trunk and a branch; and the trunk and the branch form a Y-shape-like structure.

12. The assembly of claim 11, wherein:

the first main flow pathway and the second main flow pathway are arranged inside the trunk;

the liquid inlet and the liquid outlet are arranged at two opposite ends of the trunk;

the chamber and the backflow pathway are arranged inside the branch; and the connecting flow pathway is arranged inside a junction between the trunk and the branch.

13. The assembly of claim 12, further comprising:

a sleeve clamp arranged at a top end of the trunk and coaxial with the first main flow pathway.

14. The assembly of claim 13, wherein:

the first main flow pathway includes an internal thread provided inside the top end of the first main flow pathway.

15. The assembly of claim 12, further comprising:

a side pressure-cover fixed at the junction between the trunk and the branch, and configured to close the connecting flow pathway.

16. The assembly of claim 12, wherein:

the branch includes a receiving groove provided inside a top end of the branch; and the chamber and the backflow pathway communicate with the receiving groove.

17. A spray-head apparatus comprising:

a spray-head assembly including:

a pipe structure including:

a liquid inlet;

a flow pathway including:

a chamber arranged obliquely with respect to a central axis of the liquid inlet, a bottom end of the chamber communicating with the liquid inlet, the chamber is configured to collect gas retained from the flow pathway, causing a hydraulic pressure in the chamber; and a backflow pathway arranged parallel to the chamber in communication with a top end of the chamber;

a main flow pathway communicating with the backflow pathway and extending to a liquid outlet of the pipe structure, an obtuse angle being formed between the backflow pathway and the main flow pathway; and a valve-port arranged at the top end of the chamber; and a liquid outlet, the liquid inlet and the liquid outlet being arranged at two opposite sides of the flow pathway; and a valve-spool arranged in the flow pathway and configured to control opening or closing of the valve-port in response to the hydraulic pressure being higher or lower than a preset value; and a nozzle assembly detachably connected to the spray-head assembly and communicating with the liquid outlet, wherein:

in response to the hydraulic pressure reaching the preset value, an elastic portion of the valve-spool elastically deforms to cause a sealing portion of the valve-spool to be separate from the valve-port to release the sealing portion from sealing the valve-port.

* * * * *